United States Patent [19]

Reynolds

[11] 4,394,879

[45] Jul. 26, 1983

[54] METHOD OF REPAIRING DAMAGED KEYWAY

[76] Inventor: William A. Reynolds, 311 Graham St., Emporia, Kans. 66801

[21] Appl. No.: 271,678

[22] Filed: Jun. 8, 1981

[51] Int. Cl.[3] ..... B22D 23/00

[52] U.S. Cl. ..... 164/76.1; 228/119; 29/423; 29/402.18; 164/92.1

[58] Field of Search ..... 228/119; 29/402.18, 29/423; 164/92.1, 107, 108, 131, 132, 76.1; 427/140; 428/411, 450, 454, 469, 472

[56] References Cited

U.S. PATENT DOCUMENTS

| | | | |
|---|---|---|---|
| 1,508,800 | 9/1924 | Mattice | 164/92.1 |
| 1,727,345 | 9/1929 | Kelley | 164/92.1 X |
| 3,229,361 | 1/1966 | Valacich | 29/402.18 X |
| 3,308,266 | 3/1967 | Adams | 164/108 X |
| 3,891,821 | 6/1975 | Evertz | 228/119 |

FOREIGN PATENT DOCUMENTS

| | | | |
|---|---|---|---|
| 2259845 | 6/1974 | Fed. Rep. of Germany | 164/112 |
| 56-128695 | 10/1981 | Japan | 228/119 |

*Primary Examiner*—Nicholas P. Godici
*Assistant Examiner*—M. Jordan
*Attorney, Agent, or Firm*—Schmidt, Johnson, Hovey & Williams

[57] ABSTRACT

A simple, cost effective method is provided for repairing damaged and misshapen keyways in shafts and like parts. An insert formed of carbon or other nonmetallic material which retains its shape when subjected to welding temperatures and which will not bond to weld material is provided having length and width dimensions corresponding to the final desired configuration of the restored keyway. The insert is then placed into the damaged keyway and the free space between the defining walls of the damaged keyway and the insert is filled with weld material. Excess weld and insert material above the surface of the shaft adjacent to the keyway is next machined to present a smooth, finished surface. The final step of the method involves removal of the insert from the keyway by striking the shaft or like part against an appropriate surface in order to dislodge the insert. This method effects the repair of damaged keyways without special equipment or the need for skilled workmen. The method also allows for the repair of damaged keyways in parts which heretofore could not be economically restored.

6 Claims, 6 Drawing Figures

METHOD OF REPAIRING DAMAGED KEYWAY

BACKGROUND OF THE INVENTION

1. Field of the Invention

This invention relates to a simple, cost-effective procedure for repairing damaged keyways. More particularly, the invention permits restoration of damaged keyways by placing an insert formed from stop-weld material such as carbon into a damaged keyway, placing weld material around the insert and removing the insert to present a properly formed repaired keyway.

2. Description of the Prior Art

Keyways are often the first area of a shaft or like part to be damaged by wear. Parts having keyways therein are typically made of exceptionally hard material in which new keyways normally cannot be cut. Accordingly, the conventional practice has been to simply discard such damaged parts, which is obviously uneconomic.

A number of methods for restoring worn metal parts have been proposed in the past. In general, however, such previously disclosed methods have not been directed to or usable for the formation of a keyway or other void in a hardened metal part. Patents illustrating previous restoration methods include: U.S. Pat. Nos. 3,006,064, 3,487,530 and 729,154.

A number of methods using stop-weld material in the fabrication of metal parts have also be disclosed. None of these patents, however, disclose the use of a formed insert to restore a damaged part to its original configuration. Patents illustrating the use of a stop-weld material include: U.S. Pat. Nos. 2,159,043, 2,498,275 and 3,834,800.

SUMMARY OF THE INVENTION

The problem of having to discard an entire shaft or like part having a damaged keyway therein is solved by the present method of keyway repair.

Broadly speaking, a formed insert is placed in the damaged keyway, and the free space between the insert and walls of the damaged keyway is then filled with weld material. When the welding operation is completed, the insert is removed, and a keyway having the desired cross-sectional dimensions is formed.

DESCRIPTION OF THE PREFERRED EMBODIMENT

Figure 1:
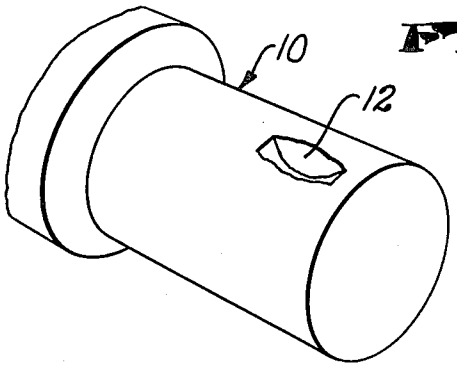
FIG. 1 is a perspective view of the end of a shaft having a damaged keyway therein.
Figure 2:
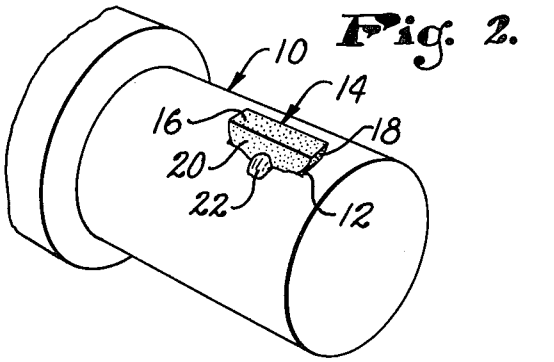
FIG. 2 is a perspective view similar to that of FIG. 1, and with a formed insert placed within the keyway.
Figure 3:
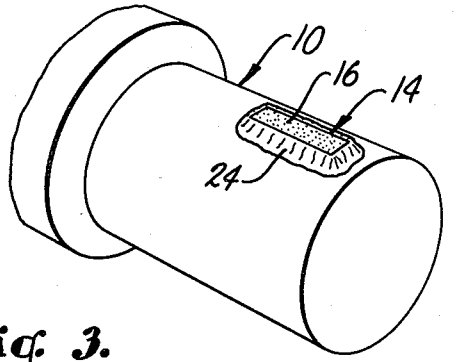
FIG. 3 is a perspective view similar to that of FIG. 2, but illustrating the insert surrounded by weld material.

Referring now to the drawing, a shaft 10 of hardened steel is shown perspectively in FIG. 1. The shaft includes a damaged and misshapen keyway 12 adjacent one end thereof, thereby rendering the shaft useless for its intended function.

Figure 4:
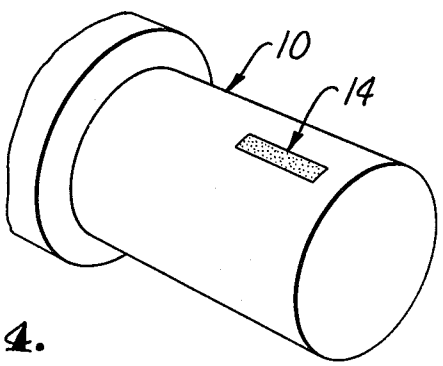
FIG. 4 is a perspective view similar to FIG. 3, and depicting the shaft of the excess welding and insert material machined away.
Figure 5:
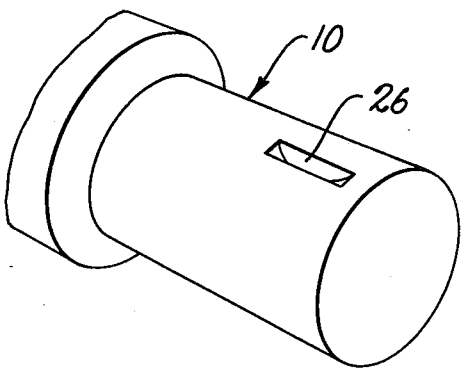
FIG. 5 is a perspective view of the end of the shaft of FIG. 1, but with a restored keyway of desired dimensions formed in the shaft end.
Figure 6:
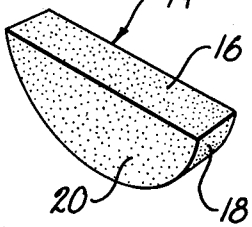
FIG. 6 is a perspective view of a formed insert preferred for use in the method of the invention.

The method of the present invention is best illustrated through a consideration of FIGS. 2–5. In the first step of the preferred method (see FIG. 2) a previously formed insert 14 is provided. The insert 14, as illustrated in FIG. 6, is preferably formed of carbon or other nonmetallic material which retains its shape when subjected to welding temperatures and which will not bond to weld material. The preferred insert 14 includes a generally planar top wall 16, a continuous arcuate wall 18 extending between and joined to the opposite ends of top wall 16 and a pair of spaced apart generally semicircular side walls 20 joined to the walls 16, 18. Of course, those skilled in the art will recognize that inserts of various configurations can be used in the instant invention, depending upon the final desired configuration of the restored keyway as will be explained hereinafter.

Referring again to FIG. 2, it will be observed that the insert 14 is placed within damaged keyway 12 in such manner that the planar top wall 16 and portions of the walls 18, 20 extend above the normal arcuate surface of the shaft adjacent the keyway. Although not absolutely necessary, it is preferred at this point to initially position and locate insert 14 by placing a small bead 22 of weld material alongside insert 14 and within the damaged keyway 12.

The next step of the method (see FIG. 3) involves filling the free space between the defining walls of the damaged keyway 12 and the insert 14 with weld material. Typically, the weld material is filleted as at 24 above the arcuate surface of the shaft 10 up to planar top wall 16 of insert 14.

After the shaft is allowed to cool, the excess weld and insert material above the arcuate surface of shaft 10 adjacent the keyway is machined to present a smooth, finished surface. This condition is best illustrated in FIG. 4, where it will be seen that the excess weld material and that portion of the insert 14 above the normal arcuate surface of the shaft have been removed. It will also be seen that the insert completely fills the keyway opening provided in the shaft 10, and that such opening is of regular rectangular configuration.

The final step of the method involves removing the remaining portion of insert 14. This is advantageously accomplished by sharply striking shaft 10 against an appropriate surface in order to dislodge the portion of insert 14 within the keyway opening. The result, as seen in FIG. 5, is a finished and restored keyway 26 having a desired, finished configuration. The restored shaft 10 is then ready for reuse in the normal manner.

As will be apprent from the foregoing, the method hereof permits restoration of keyways of virtually any desired shape. It is only necessary to provide an insert of the appropriate dimensions corresponding to those desired in the restored keyway. It will also be observed that the method hereof can be accomplished without specialized equipment or the need for skilled workmen. As such, the method is eminently suited for use in small machine shops and the like.

I claim:

1. A method of repairing a deformed or damaged keyway in a shaft or the like to provide a finished keyway having desired length and width dimensions, comprising the steps of:

providing an insert having length and width dimensions corresponding to the dimensions of the desired finished keyway;

placing said insert into the damaged keyway;

filling the free space between the defining walls of the damaged keyway and said insert with metallic weld material; and removing said insert.

2. A method as set forth in claim 1, wherein the insert is nonmetallic.

3. A method as set forth in claim 2, wherein the insert is formed of carbon.

4. A method as set forth in claim 1, including the steps of:

securing said insert by placing a small bead of weld material alonside the insert; and thereafter filling the free space between the defining walls of the damaged keyway and said insert with metallic weld material.

5. A method as set forth in claim 1, including the step of removing said insert from said keyway by striking the shaft or the like receiving said insert.

6. A method as set forth in claim 1, including the steps of:

applying excess metallic weld material about said insert, adjacent to said keyway and above the normal surface of said shaft or the like;

machining said excess weld material and any portion of said insert extending above said normal surface of the shaft or the like; and thereafter removing said insert.

* * * * *